US006948559B2

(12) United States Patent
Reinke et al.

(10) Patent No.: US 6,948,559 B2
(45) Date of Patent: Sep. 27, 2005

(54) THREE-FLUID EVAPORATIVE HEAT EXCHANGER

(75) Inventors: Michael J. Reinke, Franklin, WI (US); Jeroen Valensa, New Berlin, WI (US); Mark G. Voss, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/370,157

(22) Filed: Feb. 19, 2003

(65) Prior Publication Data

US 2004/0159424 A1 Aug. 19, 2004

(51) Int. Cl.[7] ..... F28F 3/02; F28F 13/08
(52) U.S. Cl. ..... 165/140; 165/147; 165/167
(58) Field of Search ..... 165/140, 167, 165/146, 147

(56) References Cited

U.S. PATENT DOCUMENTS 2,397,069 A * 3/1946 Young ..... 165/140
2,623,736 A * 12/1952 Hytte ..... 165/140
2,872,165 A * 2/1959 Wennerberg ..... 165/167
3,399,708 A * 9/1968 Usher et al. ..... 165/167
3,513,907 A * 5/1970 Hughes ..... 165/166
4,907,643 A * 3/1990 Grotz et al. ..... 165/140
5,009,262 A * 4/1991 Halstead et al. ..... 165/140
5,755,280 A * 5/1998 da Costa et al. ..... 165/140
5,927,396 A * 7/1999 Damsohn et al. ..... 165/140
6,044,902 A * 4/2000 Pahade et al. ..... 165/166
6,089,313 A * 7/2000 Levy et al. ..... 165/140
6,128,920 A * 10/2000 Matsuo et al. ..... 165/166

FOREIGN PATENT DOCUMENTS

JP 56010692 A * 2/1981 ..... 165/140

* cited by examiner

*Primary Examiner*—Leonard R. Leo
(74) *Attorney, Agent, or Firm*—Wood, Phillips, Katz, Clark & Mortimer

(57) ABSTRACT

An evaporative heat exchanger (10) is provided for the transfer of heat to a first fluid (30) from a second fluid (28) and a third fluid (22) to vaporize the first fluid (30). The heat exchanger (10) includes a core (40), a first flow path (60) in the core for the first fluid (30), a second flow path (66) in the core (40) for the second fluid (28), and a third flow path (68) in the core (40) for the third fluid (22). The core (40) includes a first section (42), a second section (44), and a third section (46), with the second section (44) connecting the first and third sections (42, 46). The first flow path (60) extends through all of the sections (42, 44, 46), the second flow path (66) extends through the first section (42), and the third flow path (68) extends through the third section (46).

22 Claims, 4 Drawing Sheets

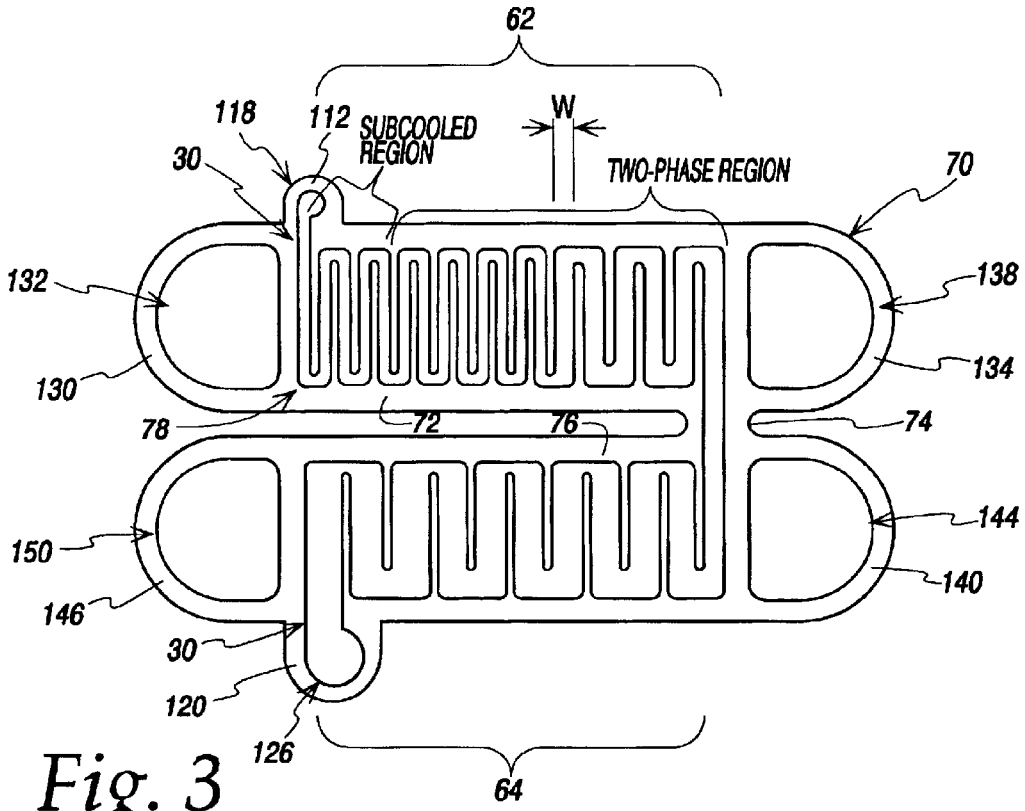
Fig. 3
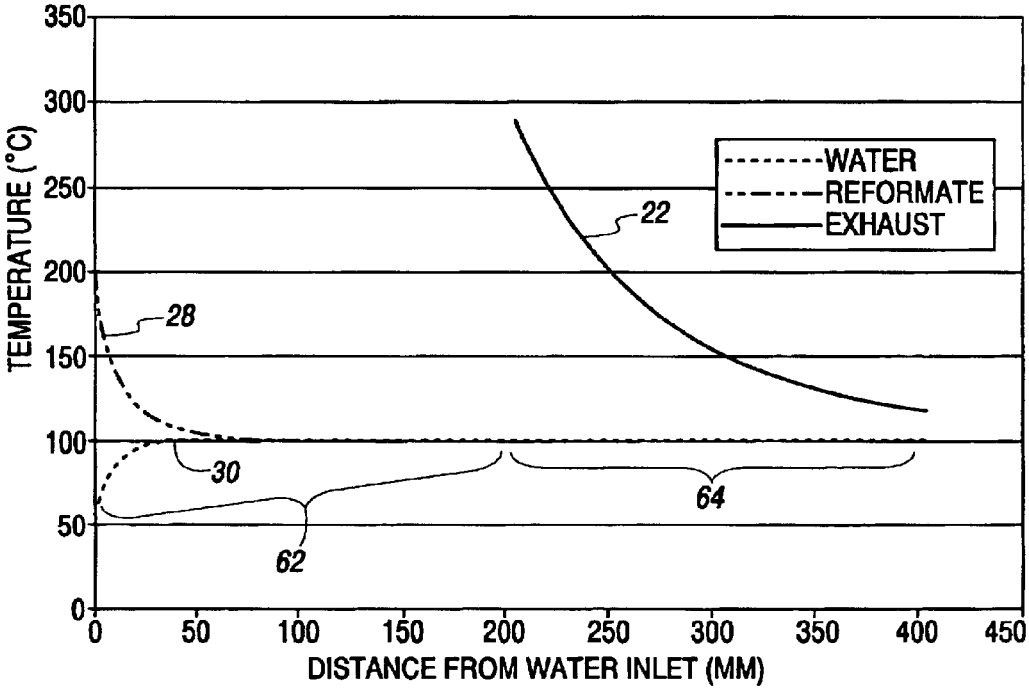
Fig. 4 -TYPICAL FLUID TEMPERATURE PROFILE - CONCURENT FLOW

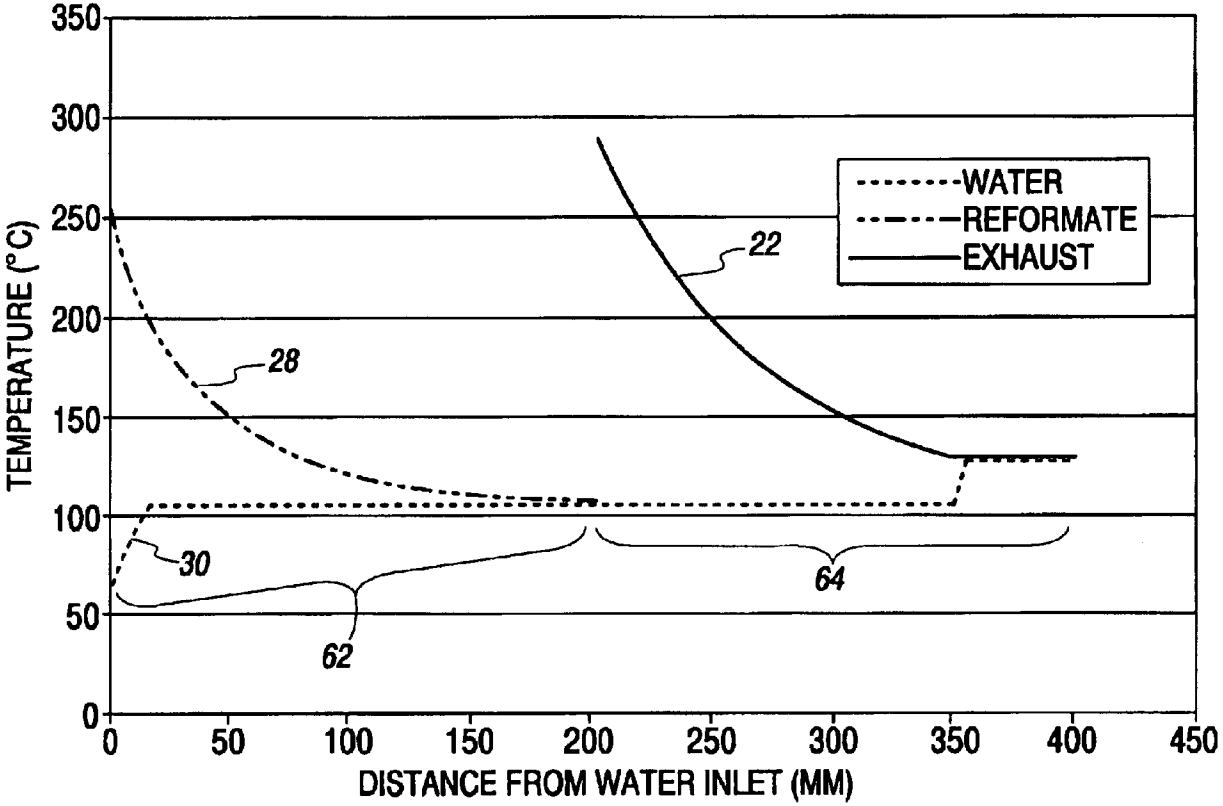
*Fig. 5* -FLUID TEMPERATURE PROFILE WITH DRYOUT- CONCURENT FLOW

THREE-FLUID EVAPORATIVE HEAT EXCHANGER

FIELD OF THE INVENTION

This invention relates to heat exchangers in general, and more particularly, to evaporative heat exchangers and heat exchangers that utilize three different working fluids, and in more particular applications to such heat exchangers used in fuel cell systems.

BACKGROUND OF THE INVENTION

Evaporative or vaporizing heat exchangers that transfer heat from one fluid flow to a vaporizing fluid flow to vaporize the vaporizing fluid flow are known. One example of such heat exchangers is found in the fuel processing systems for proton exchange membrane (PEM) type fuel cell systems, wherein a gaseous mixture of water vapor and a hydrocarbon are chemically reformed at high temperature to produce a hydrogen-rich gas flow stream known as reformate. Typically, to produce the gaseous mixture of water vapor and hydrocarbon, these systems will use an evaporative heat exchanger to either vaporize a liquid water and liquid hydrocarbon mixture, or to produce steam from liquid water which will then be used for humidification of a gaseous hydrocarbon fuel, such as methane. In some fuel processing systems, the heat from the reformate gas flow is used to provide at least part of the substantial amount of latent heat required for vaporization of the liquid flow of the vaporizing fluid, which is advantageous because it reduces the waste heat from the system and cools the reformate to the desired temperatures required for subsequent catalytic reactions. In this regard, in some systems the optimal temperature for the preferential oxidation reaction of the reformate gas flow is roughly the same as the boiling temperature for the liquid flow of the vaporizing fluid flow which makes it advantageous to use the reformate gas flow immediately upstream of the preferential oxidizer as the heat source for vaporization of the vaporizing fluid flow, thereby cooling the reformate gas flow to the desired temperature for the preferential oxidation reaction. However, typically the sensible heat given up by the reformate gas flow is not sufficient to completely vaporize the liquid flow. One other common source of additional heat in fuel cell systems is the anode exhaust gas produced by the combustion of the anode tail gas in a catalytic reactor. It is known to use the anode exhaust gas stream in a two stage vaporization procedure wherein the vaporizing fluid flow is first partially vaporized by the reformate gas stream entering the preferential oxidizer, and is subsequentially further vaporized by the anode exhaust gas stream.

While the above described systems may work well for their intended purposes, there is always room for improvements. For example, because the heat adsorbed by the liquid is mostly latent heat, a large portion of the length of each evaporator can be occupied by a two-phase fluid. Because different flow conditions can produce the same pressure drop (for example high mass flow with low quality change or low mass flow with superheat) and can therefor coexist in parallel passages, flow distribution in such evaporators is not self-correcting. Different flow distributions can result in heat fluxes that vary significantly from passage to passage which can result in poor performance and stability. Furthermore, when multiple stages are used for vaporization, there can be difficulty in redistributing the 2-phase mixture between the two stages of vaporization.

SUMMARY OF THE INVENTION

According to one form of the invention, an evaporative heat exchanger is provided for the transfer of heat to a first fluid from a second fluid and a third fluid to vaporize the first fluid. The heat exchanger includes a core, a first flow path in the core for the first fluid, a second flow path in the core for the second fluid, and a third flow path in the core for the third fluid. The core includes a first section, a second section, and a third section, with the second section connecting the first and third sections. The first and third sections are separated from each other at locations remote from the second section to allow for differences in thermal expansions between the first and third sections. The first flow path includes a first pass in the first section of the core and a second pass in the third section of the core, with the first flow path extending through the second section and being continuous between the first and second passes. The second flow path is juxtaposed with the first pass in the first section of the core to transfer heat from the second fluid to the first fluid in the first pass. The third flow pass is juxtaposed with the second pass in the third section of the core to transfer heat from the third fluid to the first fluid in the second pass.

In one form, the first flow path includes a plurality of first parallel flow passages to direct the first fluid through the heat exchanger, the second flow path includes a plurality of second parallel flow passages in the first section to direct the second fluid through the first section, and the third flow path includes a plurality of third parallel flow passages in the third section to direct the third fluid through the third section. One half of the first passages are interleaved with the second passages in the first section, and the other half of the first passages are interleaved with the third passages in the third section.

In one form, the second fluid has a concurrent flow relationship with the first fluid in the first pass. In a further form, the third fluid has a concurrent flow relationship with the first fluid in the second pass. In an alternate form, the third fluid has a counter flow relationship with the first fluid in the second pass.

In one form, the first flow path has a serpentine configuration in the first and second passes.

In one form, the first flow path has a flow area that increases in the downstream flow direction of the first fluid.

In accordance with one form of the invention, an evaporative heat exchanger is provided for the transfer of heat to a first fluid from a second fluid and a third fluid to vaporize the first fluid. The heat exchanger includes a plurality of first parallel flow passages to direct the first fluid through the heat exchanger, a plurality of second parallel flow passages to direct the second fluid through the heat exchanger, and a plurality of third parallel flow passages to direct the third fluid through the heat exchanger. Each of the first parallel flow passages has a first pass connected to a second pass. The second flow passages are interleaved with the first passes to transfer heat from the second fluid to the first fluid flowing through the first passes. The third flow passages are interleaved with the second passes to transfer heat from the third fluid to the first fluid flowing through the second passes.

In one form, each of the first flow passages has a flow area that is larger in the second pass than in the first pass.

According to one form of the invention, an evaporative heat exchanger is provided for the transfer of heat to a first fluid from a second fluid and a third fluid to vaporize the first fluid. The heat exchanger includes a plurality of parallel flow plates, and a plurality of parallel plate pairs. Each flow plate includes a first section, a second section, a third section connected to the first section by the second section, and a slot extending continuously through the first, second, and third sections to define a flow path for the first fluid through the heat exchanger. Each plate pair includes a first section interleaved with the first sections of the flow plates and enclosing a flow channel to direct the second fluid through the heat exchanger, and a second section interleaved with the third sections of the flow plates and enclosing a flow channel to direct the third fluid through the heat exchanger.

In one form, the first and second pair sections of each plate pair are separated at locations remote from the second sections of the flow plates to allow for differences in thermal expansion between the first and second sections of the plate pair. In a further form, the first and third sections of each of the flow plates are separated at locations remote from the second section of the flow plate to allow for differences in thermal expansion between the first and third sections of the flow plate.

In one form, each of the slots has a serpentine configuration in the first and third sections of the flow plate.

According to one form, each of the slots has a width that is larger in the third section than in the first section of the flow plate.

In accordance with one form of the invention, an evaporative heat exchanger is provided for use in the fuel processing system for a fuel cell system wherein the fuel processing system produces a reformate gas flow by first vaporizing a vaporizing fluid flow that comprises water, and the fuel cell system produces an anode exhaust gas flow. The evaporative heat exchanger includes a core, a first flow path in the core for the vaporizing fluid flow, a second flow path in the core for the reformate gas flow, and a third flow path in the core for the anode exhaust gas flow. The core includes a first section, a second section, and a third section, with the second section connecting the first and third sections. The first flow path includes a first pass in the first section of the core and a second pass in the third section of the core, with the first flow path extending through the second section and being continuous between the first and second passes. The second flow path is juxtaposed with the first pass in the first section of the core to transfer heat from the reformate gas flow to the vaporizing fluid flow with the first pass. The third flow path is juxtaposed with the second pass in the third section of the core to transfer heat from the anode exhaust gas flow to the vaporizing fluid flow in the second pass.

In one form, the first flow path includes a plurality of first parallel flow passages extending through the first, second, and third sections to direct the vaporizing fluid flow through the heat exchanger, the second flow path includes a plurality of second parallel flow passages in the first section to direct the reformate gas flow through the first section, and the third flow path includes a plurality of third parallel flow passages in the third section to direct the anode exhaust gas flow through the third section. The second passages are interleaved with the first passages in the first section, and the third passages are interleaved with the first passages in the third section.

Further objects, advantages, and aspects of the invention will be apparent based on the entire specification, including the appended claims and drawings.

BRIEF DESCRIPTION OF THE DRAWINGS

FIG. 3 is a plan view of a flow plate of the heat exchanger of FIG. 1;

FIG. 4 is a graph showing the temperature profiles of the working fluids of one embodiment of the heat exchanger of FIG. 1; and FIG. 5 is a graph similar to FIG. 4, but showing the temperature profiles under a dryout condition.

DETAILED DESCRIPTION OF THE PREFERRED EMBODIMENTS

Figure 1:
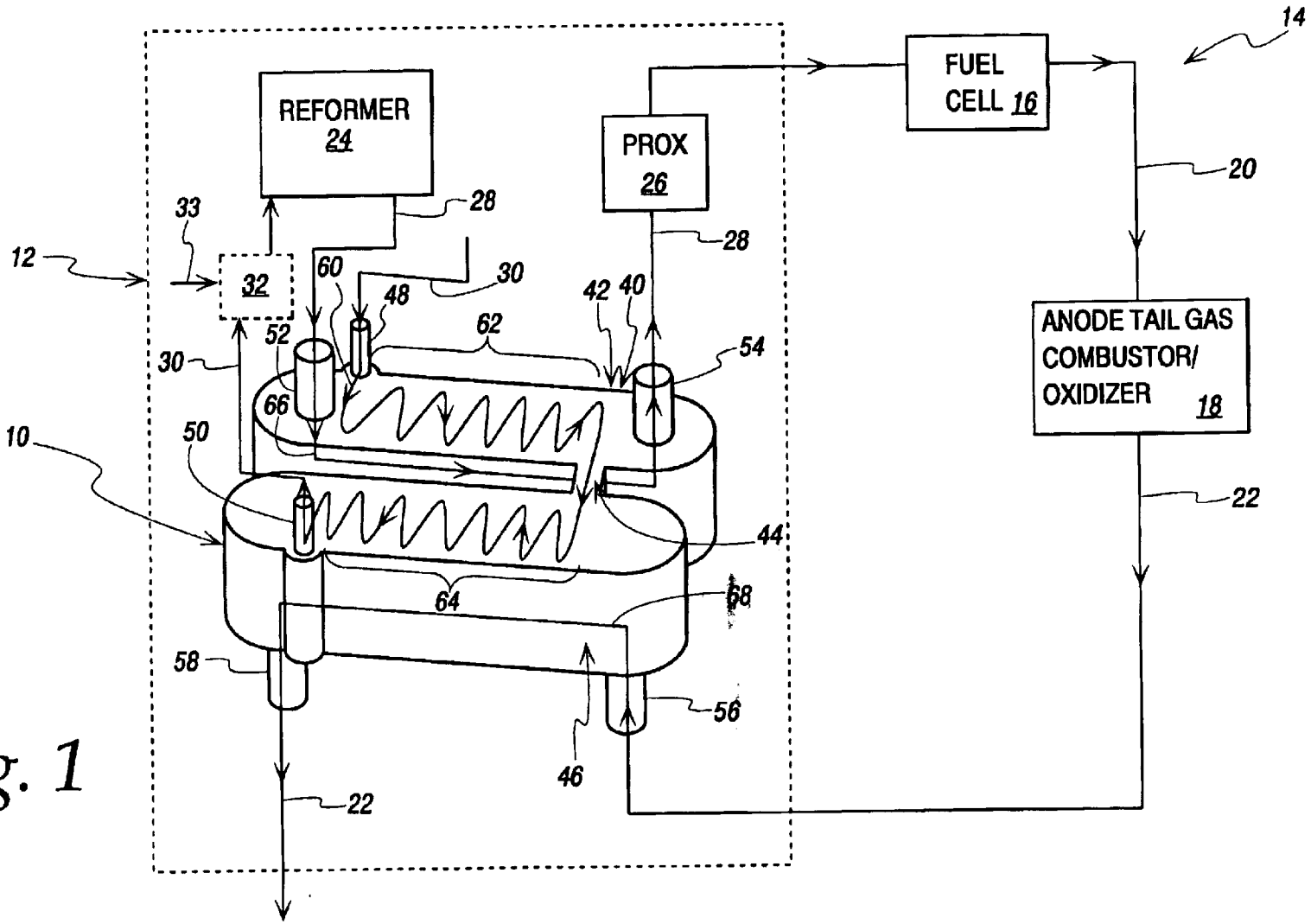
FIG. 1 is a somewhat diagrammatic illustration of a heat exchanger embodying the present invention in connection with a fuel processing system for a fuel cell system.

As seen in FIG. 1, an evaporative heat exchanger or vaporizer 10 embodying the invention is shown in connection with a fuel processing system, shown schematically at 12, for a PEM type fuel cell system 14 including a fuel cell stack 16 and an anode tail gas combustion/oxidizer 18 that combust excess fuel in an anode tail gas flow 20 from the fuel cell stack 16 in a catalytic reaction to produce an anode exhaust gas flow 22. The fuel processing system 12 includes a reformer 24 and a preferential oxidizer 26. In operation, the fuel processing system 12 produces a reformate gas flow 28 by first vaporizing a vaporizing fluid flow 30 that is provided to the reformer 24 after it is vaporized by the heat exchanger 10. In this regard, the vaporizing fluid flow 30 can be provided to the heat exchanger 10 in the form of a liquid water and liquid hydrocarbon mixture, or in the form of only liquid water which would then be vaporized and used to humidify a gaseous hydrocarbon fuel 33 (such as methane) in a humidifier (shown optionally at 32) before entering the reformer 24. The reformate gas flow 28 is passed through the heat exchanger 10 to transfer its heat to the vaporizing fluid flow 30 before the reformate 28 enters the PROX 26 so as to vaporize the vaporizing fluid 30 and lower the temperature of the reformate gas flow 28 to the desired inlet temperature for the PROX 26. The anode exhaust gas flow 22 is passed through the heat exchanger 10 to transfer its heat to the vaporizing fluid flow 30 to fully vaporize the vaporizing fluid flow 30 and recover what would otherwise be waste heat from the anode exhaust gas flow 22.

It should be understood that while the heat exchanger 10 is described herein in connection with the fuel processing system 12 of a PEM type fuel cell system 14, the heat exchanger 10 may prove useful in other types of fuel cell system and/or in systems other than fuel cell systems. Accordingly, the invention is not limited to the fuel processing system 12, or to a particular type of fuel cell system, or to fuel cell systems, unless expressly recited in the claim.

The heat exchanger 10 includes a core 40 having a first section 42, a second section 44, and a third section 46, with the second section 44 connecting the first and third sections 42 and 46. The heat exchanger 10 further includes an inlet port 48 to direct the vaporizing fluid flow 30 into the first section 42, an outlet port 50 to direct the vaporizing fluid flow 30 from the third section 46, an inlet port 52 to direct the reformate gas flow 28 into the first section 42, an outlet port 54 to direct the reformate gas flow 28 from the first section 42, an inlet port 56 to direct the anode exhaust gas flow 22 into the third section 46, and an outlet port 58 to direct the anode exhaust gas flow 22 from the third section 46. A vaporizing flow path, shown schematically at 60 is provided in the core 40, for the vaporizing fluid flow 30. The vaporizing flow path 60 includes a first pass, shown schematically at 62, in the first section 42 of the core 40 and a second pass, shown schematically at 64, in the third section 46 of the core 40. The vaporizing flow path 60 extends through the second section 44 and is continuous between the first and second passes 62 and 64. A second flow path, shown schematically at 66, is provided in the first section 42 for the reformate gas flow 28. The second flow path 66 is juxtaposed with the first pass 62 in the first section 42 to transfer heat from the reformate gas flow 28 to the vaporizing fluid flow 30 in the first pass 62. A third flow path, shown schematically at 68, is provided in the third section 46 for the anode exhaust gas flow 22. The third flow path 68 is juxtaposed with the second pass 64 in the third section 46 to transfer heat from the anode exhaust gas flow 22 to the vaporizing fluid flow 30 in the second pass 64.

Figure 2:
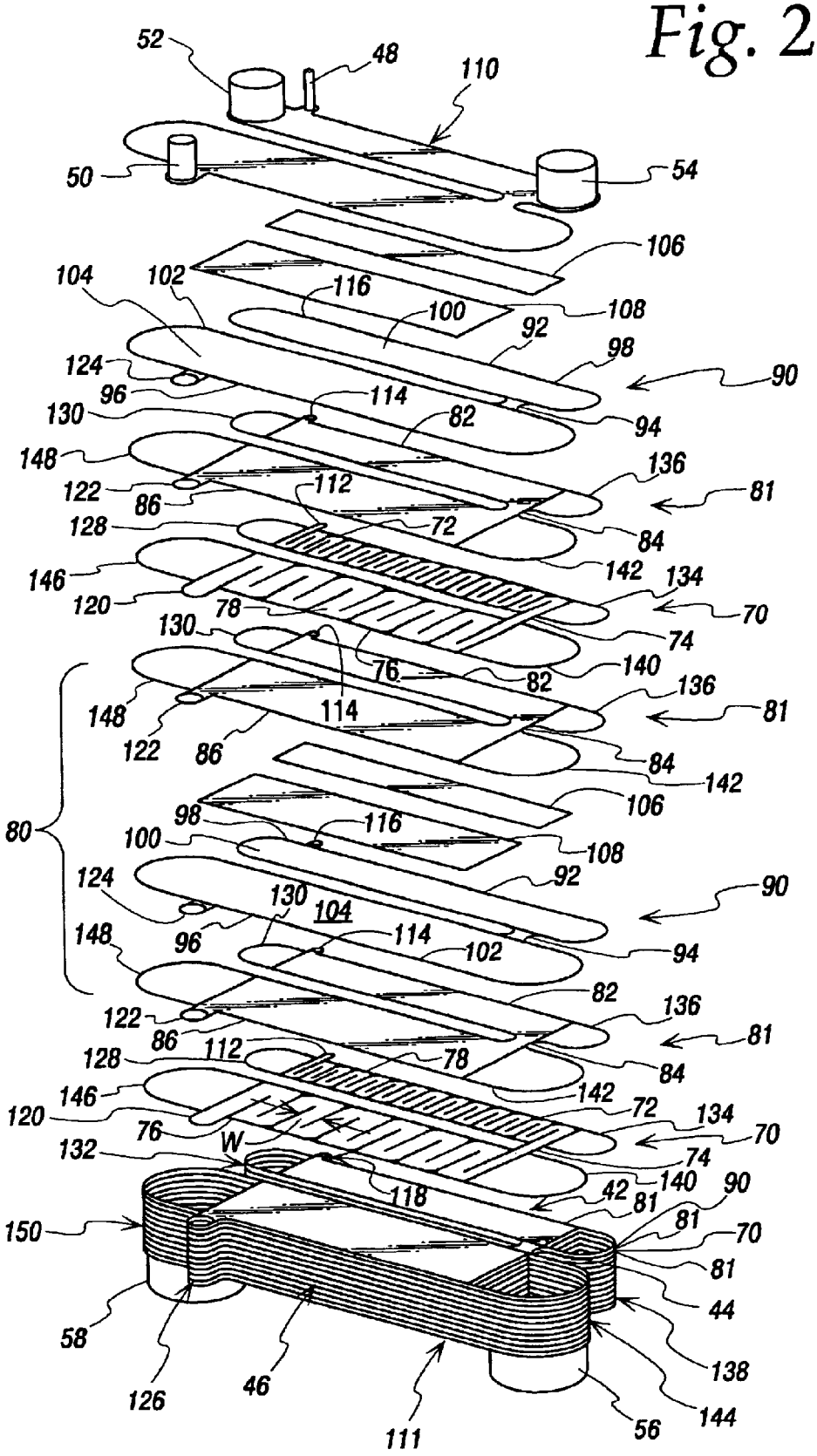
FIG. 2 is a partially exploded perspective view of the heat exchanger of FIG. 1.

Turning in more detail to the construction of a preferred embodiment of the heat exchanger 10, as best seen in FIG. 2, the core 40 is a stacked bar-plate type construction including a plurality of parallel flow plates 70, with each of the flow plates including a first section 72 corresponding to the first section 42 of the core 40, a second section 74 corresponding to the second section 44 of the core 40, and a third section 76 corresponding to the third section 46 of the core 40. An open channel or slot 78 extends continuously through the first, second, and third sections 72, 74, and 76 of each flow plate 70 to define the flow path 60 for the vaporizing fluid 30. Each slot 78 has a width W that increases as the slot 78 extends through the sections 72, 74, and 76 to accommodate the decreasing density of the vaporizing fluid flow 30 as it is vaporized. The slot 78 has a serpentine configuration in each of the first and third sections 72 and 76 to provide localized cross flow paths for the vaporizing fluid flow 30 relative to the reformate gas flow 28 in the first section 42 and the anode exhaust gas flow 22 in the third section 46. The serpentine configuration of the slot 78 in the first section 72 corresponds to the first pass 62, and the serpentine configuration of the slot 78 in the third section 76 corresponds to the second pass 64.

The core 40 also includes a plurality of separator plate pairs 80 interleaved with the flow plates 70, with each pair 80 including a pair of separator plates 81. Each plate 81 include a first section 82 corresponding to the first sections 42 and 72, a second section 84 corresponding to the second sections 44 and 74, and a third section 86 corresponding to the third sections 46 and 76. Each of the plate pairs 80 includes a frame 90 sandwiched between the plates 81 of the plate pair 80, with the frame 90 including a first section 92 corresponding to the first sections 42, 72 and 82, a second section 94 corresponding to the second sections 44, 74, and 84, and a third section 96 corresponding to the third sections 46, 76, and 86. The first section of each of the frames 92 have a continuous peripheral rim 98 that surrounds a flow chamber 100 for the reformate gas flow 28, and each of the third sections 96 has a peripheral rim 102 surrounding a flow chamber 104 for the anode exhaust gas flow 22. Preferably, the thickness of the frame 90 in the stacked direction is the same in all of the sections 92, 94, and 96. Preferably, suitable turbulators or fins, such as fins 106 and 108 are provided in each of the flow chambers 100 and 104, respectively, and are bonded on each of their sides to the plates 81 of the pair 80 to improve the heat transfer between the respective gas flows 28 and 22 and the plates 81 of the pair 80. Each of the plates 81 of the plate pairs 80 are solid in the areas that overlie the flow channel 78 so as to enclose the flow channel 78 when the plate pairs 80 are interleaved with the flow plates 70. Plates 110 and 111 are provided on the top and bottom of the core 40 to serve as one of the plates 81 of the topmost and bottommost plate pairs 80, respectively, and to mount the ports 48, 50, 52, 54, 56 and 58 of the heat exchanger 10.

The first and third sections 42 and 46 and the corresponding first and third sections 72, 82, 92, and 76, 86, and 96 are separated at locations remote from the second sections 44, 74, 84, and 94, so that the heat exchanger 10 can accommodate relatively unconstrained differential thermal expansion of each of the sections 42 and 46 of the core 40 relative to each other, thereby minimizing mechanical stresses due to the thermal growth.

Tab-like extensions 112, 114 and 116 are provided on the flow plates 70, the plates 81, and the frames 90, respectively, to define an inlet manifold 118 underlying the inlet 48 for directing the vaporizing fluid 30 from the inlet port 48 into the slots 78 of the flow path 60. Tab like extensions 120, 122, and 124 are provided on the flow plates 70, plates 81, and frames 90, respectively, to define an outlet manifold 126 underlying the outlet port 50 for directing the vaporizing fluid flow 30 from the slots 78 of the flow path 60 to the outlet port 50. Peripheral rim extensions 128 and 130 are provided on the flow plates 70 and the plates 81, respectively, to define, in combination with the rims 98, an inlet manifold 132 underlying the inlet port 52 for directing the reformate gas flow 28 from the inlet port 52 into the flow channels 100 of the second flow path 66. Peripheral rim extensions 134 and 136 are provided on the flow plates 70 and the plates 81, respectively, to define, in combination with the rims 98, an outlet manifold 138 underlying the outlet port 54 for directing the reformate gas flow 28 from the flow channels 100 of the second flow path 66 into the outlet port 54. Peripheral rim extensions 140 and 142 are provided on the flow plates 70 and the plates 81, respectively, to define, in combination with the rims 102, an inlet manifold 144 overlying the inlet port 56 for directing the anode exhaust gas flow 22 from the port 54 into the flow channels 104 of the third flow path 68. Peripheral rim extensions 146 and 148 are provided on the flow plates 70 and separator plates 81, respectively, to define, in combination with the rims 102, an outlet manifold 150 overlying the outlet port 58 for directing the anode exhaust gas flow 22 from the flow channels 104 into the outlet port 58.

Preferably, each of the above described components of the heat exchanger 10 are made of a suitable metal material, such as aluminum, steel, or copper, with the plates 70 and 81 being made from thin metal sheets and all of the components being joined together using suitable bonding techniques such as soldering, brazing, or welding.

As an option, the portion of the each of the slots 78 immediate downstream of the inlet manifold 118 can be designed, such as by locally narrowing each of the portions, to have a large pressure drop, as may be available from the pump for the vaporizing fluid flow 30, so as to force an even distribution of the vaporizing fluid flow 30 to each of the slots 78. One of the advantages of such a design is that it would provide, inherently, a low likelihood of maldistribution. Because the first pass 62 preferably has a long "pinched" region, any potential maldistribution of the liquid from layer to layer would have a strong impact on pressure drop. Vapor quality is almost fixed in the first pass 62 because the available heat in the gas flow 28 is entirely consumed (temperature drops to the boiling point of the fluid flow 30). This effectively dampens out the maldistribution possibility mentioned in the Background section.

It should be appreciated that while a bar-plate type design is shown, other types of constructions could be employed for the core 40, such as for example, a drawn cup type construction for each of the plate pairs 80. It should also be appreciated that while it is preferred to provide turbulators or fins between the plates 81 of each pair 80, in some applications it may be desirable to forego the turbulators or fins 106 and/or 108, or to provide dimples in the plates 81 that abut the dimples in the opposite plate 81 of the pair 80. It should also be appreciated that the width of each of the flow chambers 100 and 104 can vary between the two different types of gasses flowing therethrough, as shown, and also can vary from application to application, as can the details of the particular type and configuration of turbulators or fins employed therein.

As best seen in FIG. 3, in operation, the vaporizing fluid flow 30 is directed from the manifold 118 into the slots 78 of each of the flow plates 70 and traverses the serpentine configuration of the first pass 62 through the first section 72 and begins to vaporize before reaching the end of the first pass 62 such that there is two-phase flow of the vaporizing fluid 30 exiting the first pass 62 and the first section 42 of the core 40. The vaporizing fluid flow 30 flows continuously in each of the slots 78 from the first section 72 through the second section 74 to the third section 76, thereby eliminating the need for redistribution of the two-phase fluid and preventing drop-out of the liquid portion of the two-phases. The vaporizing fluid flow 30 then traverses the serpentine configuration of the second pass 64 through the third section 76 to the outlet manifold 126 and is preferably completely vaporized before reaching the end of the slot 78 so that there is a superheat region for the vaporizing fluid flow 30 in the third section 46 of the core 40. Thus, the vaporizing fluid flow 30, which in the illustrated embodiment is water, is heated to a high quality water/steam mixture to be used for humidification of the fuel for the fuel cell 16.

In the illustrated embodiment, each gas flow 28 and 22 has a concurrent flow relationship with the vaporizing fluid flow 30 in their respective sections 42 and 46 of the core 40. FIG. 4 shows a typical temperature profile for the fluids 22, 28 and 30 of the heat exchanger. As seen in FIG. 4, the effectiveness of the first section 42 of the core is such that the reformate gas flow 28 is made to pinch at the boiling point of the vaporizing fluid flow 30 (water in the illustrated embodiment), thereby making the exit temperature of the reformate gas flow 28 from the heat exchanger very constant. This is advantageous because it can provide the reformate gas flow 28 at the optimum temperature for the PROX 26 without requiring an active control scheme for the reformate gas flow 28. As also seen in FIG. 4, the concurrent flow of the anode exhaust gas flow 22 in the third section 46 has the advantages of limiting the temperature excursions of the material(s) of the heat exchanger which could occur if one or more of the slots 78 were to completely dry out and super heat. This is best seen in connection with FIG. 5 which depicts simulated dry out occurring three quarters of the way through the third section 46 and shows that the temperature rise of the vaporizing fluid flow 30 is limited because the temperature of the anode exhaust gas flow 22 has decreased relatively rapidly in the third section 46 due to the latent heat adsorbed by the vaporizing fluid flow 30.

It is preferably to have both of the hot gas flows 28 and 22 concurrent with the vaporizing fluid flow 30 in their respective sections 42 and 46 of the heat exchanger because this flow arrangement can help to ensure stability of the fluid temperatures exiting the heat exchanger and maximize the structural integrity of the heat exchanger. However, in some applications, it may be desirable to have one or both of the hot gas flows 28 and 22 to be counter flows with respect to the vaporizing fluid flow 30 in their respective sections 42 and 46. For example, in some applications, it may be necessary to ensure full vaporization and superheating of the vaporizing fluid flow 30 under all conditions, which may necessitate counter flow of the anode exhaust gas flow 22 in the third section 46 so as to provide a sufficient temperature differential for heat transfer in the superheat region of the third section 46. However, this type of counter flow arrangement can result in high thermal induced stresses in the plates 81 at the dry out location. Accordingly, care must be taken to address thermal stress concerns in this type of counter flow design.

What is claimed is:

1. An evaporative heat exchanger for the transfer of heat to a first fluid from a second fluid and a third fluid to vaporize the first fluid, the heat exchanger comprising:

a plurality of separate first parallel flow passages to direct the first fluid through the heat exchanger, each of the flow passages having a first pass connected to a second pass, each of the first and second passes having a serpentine confirmation;

a plurality of second parallel flow passages to direct the second fluid through the heat exchanger, the second flow passages interleaved with the first passes to transfer heat from the second fluid to the first fluid flowing through the first passes; and a plurality of third parallel flow passages to direct the third fluid through the heat exchanger, the third flow passages interleaved with the second passes to transfer heat from the third fluid to the first fluid flowing through the second passes.

2. The heat exchanger of claim 1 wherein the second fluid has a concurrent flow relationship with the first fluid in the first pass.

3. The heat exchanger of claim 2 wherein the third fluid has a concurrent flow relationship with the first fluid in the second pass.

4. The heat exchanger of claim 2 wherein the third fluid has a counter flow relationship with the first fluid in the second pass.

5. The heat exchanger of claim 2 wherein each of the first flow passages has a flow area that is larger in the second pass than in the first pass.

6. An evaporative heat exchanger for the transfer of heat to a first fluid from a second fluid and a third fluid to vaporize the first fluid, the heat exchanger comprising:

a plurality of parallel flow plates, each flow plate including a first section, a second section, a third section connected to the first section by the second section, and a slot extending continuously through the first, second and third sections to define a flow path for the first fluid through the heat exchanger;

a plurality of parallel plate pairs, each plate pair including a first section interleaved with the first sections of the flow plates and enclosing a flow channel to direct the second fluid through the heat exchanger and a second section interleaved with the third sections of the flow plates and enclosing a flow channel to direct the third fluid through the heat exchanger.

7. The heat exchanger of claim 6 wherein the first and second sections of each plate pair are separated at locations remote from the second sections of the flow plates to allow for differences in thermal expansion between the first and second sections of the plate pair.

8. The heat exchanger of claim 7 wherein the first and third sections of each of the flow plates are separated at locations remote from the second section of the flow plate to allow for differences in thermal expansion between the first and third sections of the flow plate.

9. The heat exchanger of claim 6 wherein each of the continuous slots has a serpentine configuration in the first and third sections.

10. The heat exchanger of claim 6 wherein each of the slots has a width that is larger in the third section than in the first section of the flow plate.

11. An evaporative heat exchanger for the transfer of heat to a first fluid from a second fluid and a third fluid to vaporize the first fluid, the heat exchanger comprising:

a core including a first section, a second section, and a third section, the second section connecting the first and third sections, the first and third sections separated from each other at locations remote from the second section to allow for differences in thermal expansion between the first and third sections;

a first flow path in the core for the first fluid, the first flow path including a first pass in the first section of the core and a second pass in the third section of the core, the first flow path extending through the second section and being continuous between the first and second passes;

a second flow path in the core for the second fluid, the second flow path juxtaposed with the first pass in the first section of the core to transfer heat from the second fluid to the first fluid in the first pass; and a third flow path in the core for the third fluid, the third flow path juxtaposed with the second pass in the third section of the core to transfer heat from the third fluid to the first fluid in the second pass, wherein the first flow path includes a plurality of separate first parallel flow passages to direct the first fluid through the heat exchanger, the second flow path includes a plurality of second parallel flow passages in the first section to direct the second fluid through the first section, and the third flow path includes a plurality of third parallel flow passages in the third section to direct the third fluid through the third section, the second passages are interleaved with the first passages in the first section, and the third passages are interleaved with the first passages in the third section, each of the first parallel flow passages extending continuously through each of the first, second and third sections.

12. The heat exchanger of claim 11 wherein the second fluid has a concurrent flow relationship with the first fluid in the first pass.

13. The heat exchanger of claim 12 wherein the third fluid has a concurrent flow relationship with the first fluid in the second pass.

14. The heat exchanger of claim 12 wherein the third fluid has a counter flow relationship with the first fluid in the second pass.

15. The heat exchanger of claim 12 wherein the first flow path has a serpentine configuration in the first and second passes.

16. The heat exchanger of claim 12 wherein the first flow path has a flow area that increases in the downstream flow direction of the first fluid.

17. An evaporative heat exchanger for use in a fuel processing system for a fuel cell system wherein the fuel processing system produces a reformate gas flow by first vaporizing a vaporizing fluid flow that comprises water and the fuel cell system produces an anode exhaust gas flow, the evaporative heat exchanger comprising:

a core including a first section, a second section, and a third section, the second section connecting the first and third sections;

a first flow path in the core for the vaporizing fluid flow, the first flow path including a first pass in the first section of the core and a second pass in the third section of the core, the first flow path extending through the second section and being continuous between the first and second passes;

a second flow path for the reformate gas flow, the second flow path juxtaposed with the first pass in the first section of the core to transfer heat from the reformate gas flow to the vaporizing fluid flow in the first pass; and a third flow path for the anode exhaust gas flow, the third flow path juxtaposed with the second pass in the third section of the core to transfer heat from the anode exhaust gas flow to the vaporizing fluid flow in the second pass, wherein the first flow path includes a plurality of separate first parallel flow passages to direct the vaporizing fluid through the heat exchanger, the second flow path includes a plurality of second parallel flow passages in the first section to direct the reformate gas flow through the first section, and the third flow path includes a plurality of third parallel flow passages in the third section to direct the anode exhaust through the third section, the second passages are interleaved with the first passages in the first section, and the third passages are interleaved with the first passages in the third section, each of the first parallel flow passages extending continuously through each of the first, second and third sections.

18. The heat exchanger of claim 17 wherein the reformate gas flow has a concurrent flow relationship with the vaporizing fluid flow in the first pass.

19. The heat exchanger of claim 18 wherein the anode exhaust has a concurrent flow relationship with the vaporizing fluid flow in the second pass.

20. The heat exchanger of claim 18 wherein the anode exhaust has a counter flow relationship with the vaporizing fluid flow in the second pass.

21. The heat exchanger of claim 17 wherein the first flow path has a serpentine configuration in the first and second passes.

22. The heat exchanger of claim 17 wherein the first flow path has a flow area that increases in the downstream direction of the first fluid.

* * * * *

UNITED STATES PATENT AND TRADEMARK OFFICE

CERTIFICATE OF CORRECTION

PATENT NO. : 6,948,559 B2
APPLICATION NO. : 10/370157
DATED : September 27, 2005
INVENTOR(S) : Michael J. Reinke et al.

It is certified that error appears in the above-identified patent and that said Letters Patent is hereby corrected as shown below:

Column 8, line 15, delete “confirmation” and substitute therefor --configuration--.

Signed and Sealed this

Third Day of April, 2007

JON W. DUDAS
*Director of the United States Patent and Trademark Office*